US011464699B1

(12) United States Patent
Muthusami

(10) Patent No.: US 11,464,699 B1
(45) Date of Patent: Oct. 11, 2022

(54) PORTABLE INGROUND CREMATION REMAINS MEMORIAL

(71) Applicant: Jayakumar Muthusami, College Station, TX (US)

(72) Inventor: Jayakumar Muthusami, College Station, TX (US)

( * ) Notice: Subject to any disclaimer, the term of this patent is extended or adjusted under 35 U.S.C. 154(b) by 157 days.

(21) Appl. No.: 16/784,168

(22) Filed: Feb. 6, 2020

Related U.S. Application Data

(60) Provisional application No. 62/802,584, filed on Feb. 7, 2019.

(51) Int. Cl.
*A61G 17/08* (2006.01)
*B65D 53/02* (2006.01)

(52) U.S. Cl.
CPC ..... *A61G 17/08* (2013.01); *B65D 53/02* (2013.01)

(58) Field of Classification Search
CPC .... A61G 17/08; E04H 13/003; E04H 13/008; E04H 13/00; B65D 53/02
USPC ..... 27/1, 35; 52/103
See application file for complete search history.

(56) References Cited

U.S. PATENT DOCUMENTS 2,235,617 A * 3/1941 Klinzing ..... A61G 17/08 220/288
2,385,520 A * 9/1945 Klinzing ..... A61G 17/08 27/1
4,328,606 A * 5/1982 Nunes ..... E04H 13/006 27/35
5,692,277 A * 12/1997 Chen ..... A61G 17/0136 27/17
5,832,575 A * 11/1998 Sturino ..... A61G 17/08 27/1
6,006,458 A * 12/1999 Weiss ..... A61G 17/08 40/124.5
6,052,954 A * 4/2000 Dudek ..... A61G 17/0136 52/128
6,167,600 B1 * 1/2001 Williams ..... E04H 13/006 27/1
6,389,664 B1 * 5/2002 Wood ..... A61G 17/08 27/1
6,463,703 B1 * 10/2002 Mattis ..... E04H 13/003 52/103
6,904,721 B1 * 6/2005 Forbes ..... E04H 13/008 52/103
6,944,921 B1 * 9/2005 Gersten ..... A61G 17/08 27/1
6,988,299 B1 * 1/2006 Barrette ..... A61G 17/08 27/1
7,178,209 B1 * 2/2007 Radziewicz ..... A61G 17/08 27/1
7,191,498 B2 * 3/2007 Fischer ..... A61G 17/08 27/1
8,087,132 B2 * 1/2012 Forrest ..... A61G 17/0106 27/1
9,334,669 B1 * 5/2016 Byndon ..... E04H 13/008
9,441,393 B1 * 9/2016 Muthusami ..... E04H 13/001
(Continued)

*Primary Examiner* — William L Miller
(74) *Attorney, Agent, or Firm* — Nick A Nichols, Jr

(57) ABSTRACT

A portable inground cremation memorial may include a receptacle for holding cremation remains. A cremains capsule, and cremation remains placed therein, may be secured in the receptacle and sealed in the memorial. The portable inground cremation memorial may be interred and may thereafter be uninterred and transported from one location and reinterred in another location.

6 Claims, 6 Drawing Sheets

(56) References Cited

U.S. PATENT DOCUMENTS

2001/0049867 A1* 12/2001 Tseng ..... A61G 17/08
27/1
2003/0024089 A1* 2/2003 Dziekonski ..... A61G 17/08
27/1
2005/0055812 A1* 3/2005 Fischer ..... A61G 17/08
27/1
2005/0120525 A1* 6/2005 Heil ..... A61G 17/08
27/1
2005/0125973 A1* 6/2005 Hankel ..... A61G 17/007
27/1
2007/0084027 A1* 4/2007 Walczak ..... A61G 17/007
27/1
2008/0264882 A1* 10/2008 Sviberg-Krahner .....
A61G 17/0166
211/85.27
2009/0020488 A1* 1/2009 Turkel ..... A61G 17/08
211/85.27
2010/0012606 A1* 1/2010 Bourgo ..... A61G 17/08
211/85.27
2010/0139060 A1* 6/2010 Leeder ..... E04H 13/008
27/1
2011/0191993 A1* 8/2011 Forrest ..... A61G 17/08
27/1
2013/0185907 A1* 7/2013 Langelier ..... E04H 13/008
27/1
2014/0215933 A1* 8/2014 Carlson ..... A61G 17/0136
52/103
2015/0013124 A1* 1/2015 Bailey ..... E04H 13/008
27/1
2015/0128391 A1* 5/2015 Lynch ..... A61G 17/08
27/1
2019/0231628 A1* 8/2019 Reynolds ..... A61G 17/08

* cited by examiner

PORTABLE INGROUND CREMATION REMAINS MEMORIAL

CROSS-REFERENCE TO RELATED APPLICATION

This application claims priority to and the benefit of the filing date of U.S. Provisional Application Ser. No. 62/802,584, filed Feb. 7, 2019, which application is herein incorporated by reference in its entirety.

BACKGROUND

The present invention relates generally to the funeral products industry, and more particularly to a cremation remains memorial.

Cremation is a growing segment of the funeral industry and there is a growing demand for new and innovative products to personalize and commemorate the lives of the deceased (humans or pets) by their loved ones. Consequently, the use of plastic bags or cardboard boxes to preserve and store cremation remains is not a desirable method of honoring the lives of loved ones.

There is a continuing demand in the funeral industry for new designs and styles of funeral products, particularly products that provide for a holistic approach for memorializing the lives of the deceased and bringing comfort to the family members of the deceased.

Very few options are available for family members to have an individual or family memorial that is portable, i.e. the memorial may be buried at one location and later moved to another location. It is therefore an object of the invention to provide a portable cremation remains memorial that may be removed from one location and reinterred to another location, such as but without limitation, a cemetery, back yard and the like.

SUMMARY

A portable cremation remains memorial may include a receptacle for holding cremation remains. A cremains capsule, and cremation remains placed therein, may be secured in the receptacle and sealed in the memorial. The portable inground cremation remains memorial may be interred in a first location and may thereafter be uninterred and reinterred in another location.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
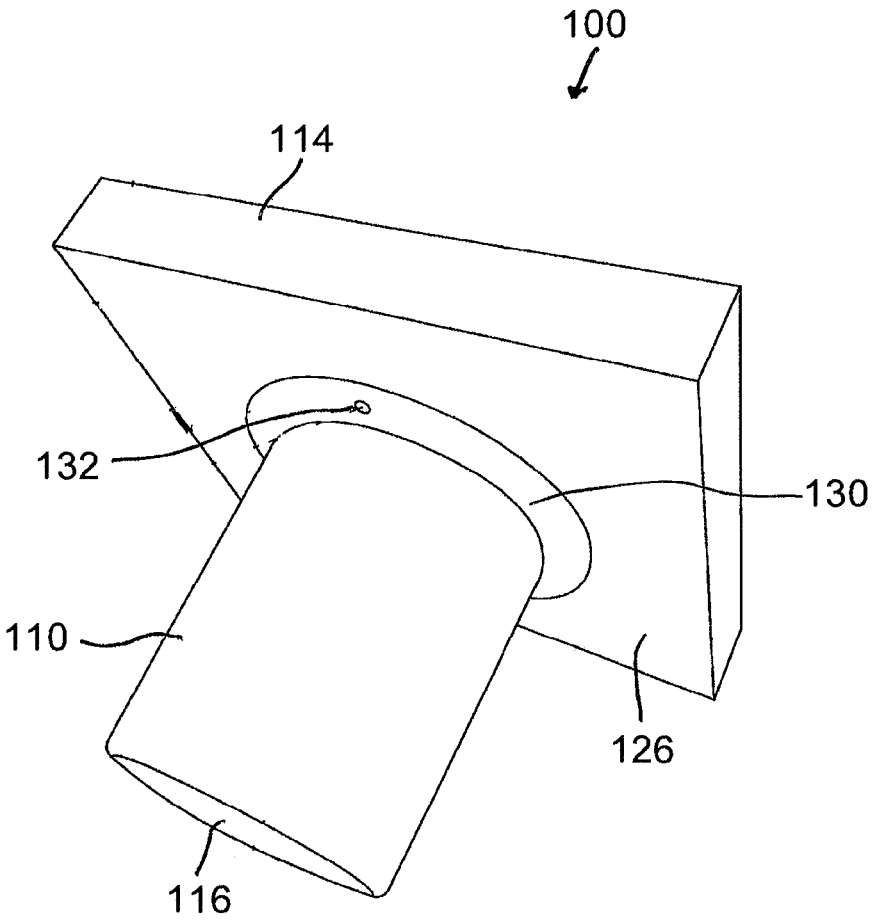
FIG. 1 is a perspective view of portable cremation remains memorial.
Figure 2:
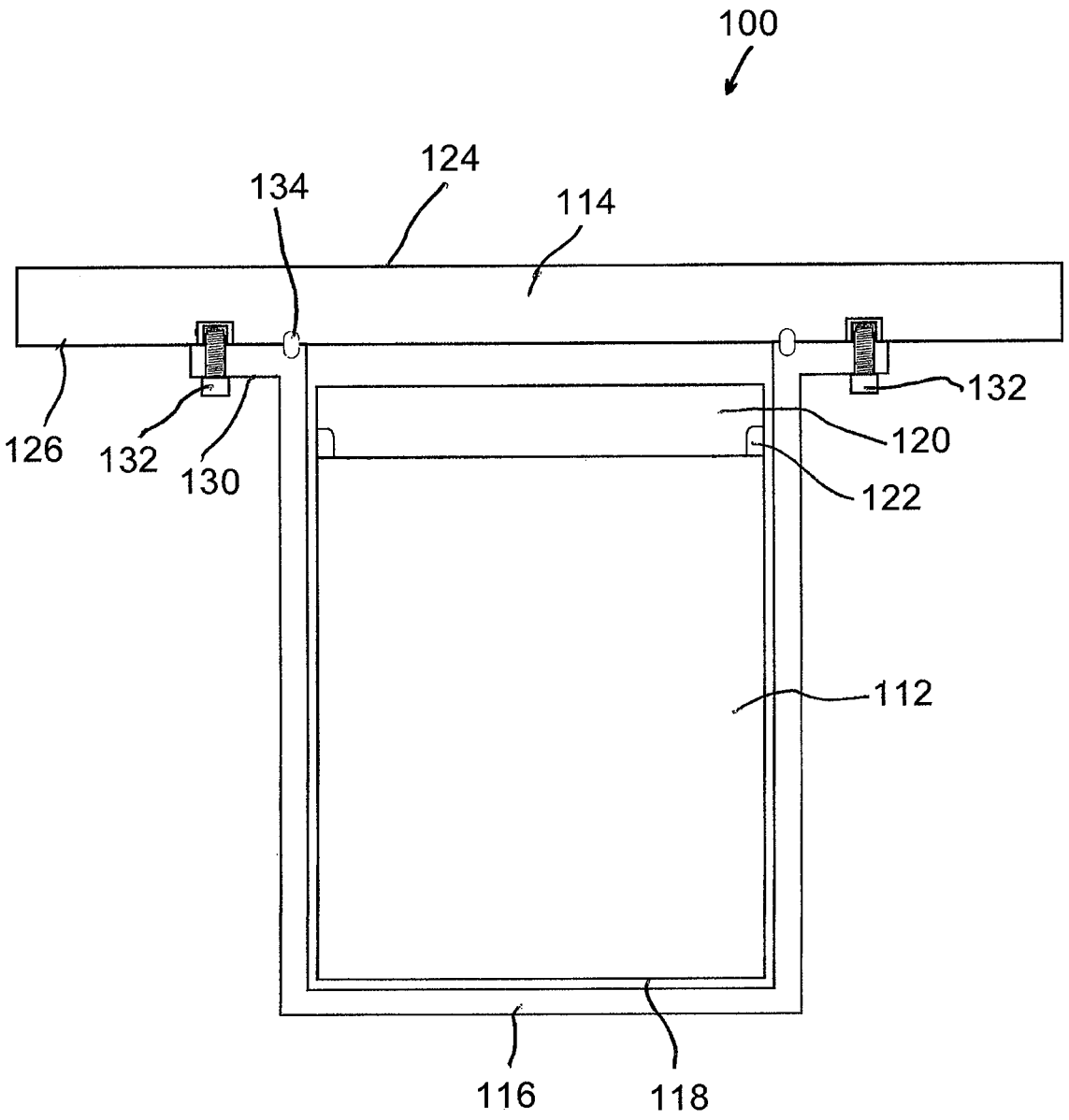
FIG. 2 is a section view of the portable cremation remains memorial shown in FIG. 1.

Referring first to FIGS. 1 and 2, a portable cremation remains memorial is generally identified by the reference numeral 100. The portable cremation remains memorial 100 may include a cremation vessel or receptacle 110, cremains capsule 112, shown in FIG. 2, and a cap plate or memorial plate 114. It may be observed that the cremation receptacle 110 and the cremains capsule 112 are depicted in the FIGS. 1-7 as having a substantially cylindrical body. The cremation receptacle 110 and the cremains capsule 112 may include closed bottom ends 116 and 118, respectively, and may be open at the opposite upper ends thereof. The cremation receptacle 110 and capsule 112 may preferably be fabricated from stainless steel but may also be made from other materials, such as but without limitation, plastic and the like, suitable to the environmental conditions where the cremation remains will be interred. It will also be understood that the cylindrical configuration of the cremation receptacle 110 and capsule 112, is illustrative only, as the cremation receptacle 110 and capsule 112 may be formed into many configurations in various sizes and shapes and have different volume capacities to accommodate the storage of human and pet cremation remains as circumstances may require.

The open end of the cremains capsule 112 may be closed by a removable lid 120. A seal or gasket 122 may be secured about the open end of the cremains capsule 112 which mates with the lid 120 such that a watertight seal may be formed about the open end of the cremains capsule 112. Watertight sealing may prevent contamination of the interred cremains in a ground environment.

Referring again to FIG. 2, the cremation receptacle 110 may be removably mounted to the memorial plate 114. For illustrative purposes, but without limitation, the plate 114 may be fabricated from granite, marble or other suitable material. The plate 114 may include a top surface 124 and a bottom surface 126. At an interment site, the top surface 124 of the plate 114 is visible at the ground surface and the rest of the portable cremation remains memorial 100 is below the ground surface. A flange 130 may circumscribe the open upper end of the cremation receptacle 110. Mounting bolts 132 received through drilled hole in the flange 130 may secure the cremation receptacle 110 to the bottom surface 126 of the memorial plate 114. A seal 134, for example but without limitation, an o-ring seal, may be disposed between the bottom surface 126 of the memorial plate 114 and the flange 130 to form an additional watertight seal about the open upper end of the receptacle 110. The dual seal design of the portable cremation remains memorial 100, to wit, a first seal 122 about the open upper end of the cremains capsule 112 and a second seal or gasket 134 disposed between the memorial plate 114 and the receptacle 110, may provide weatherproof storage for the cremation remains in the cremains capsule 112.

Figure 3:
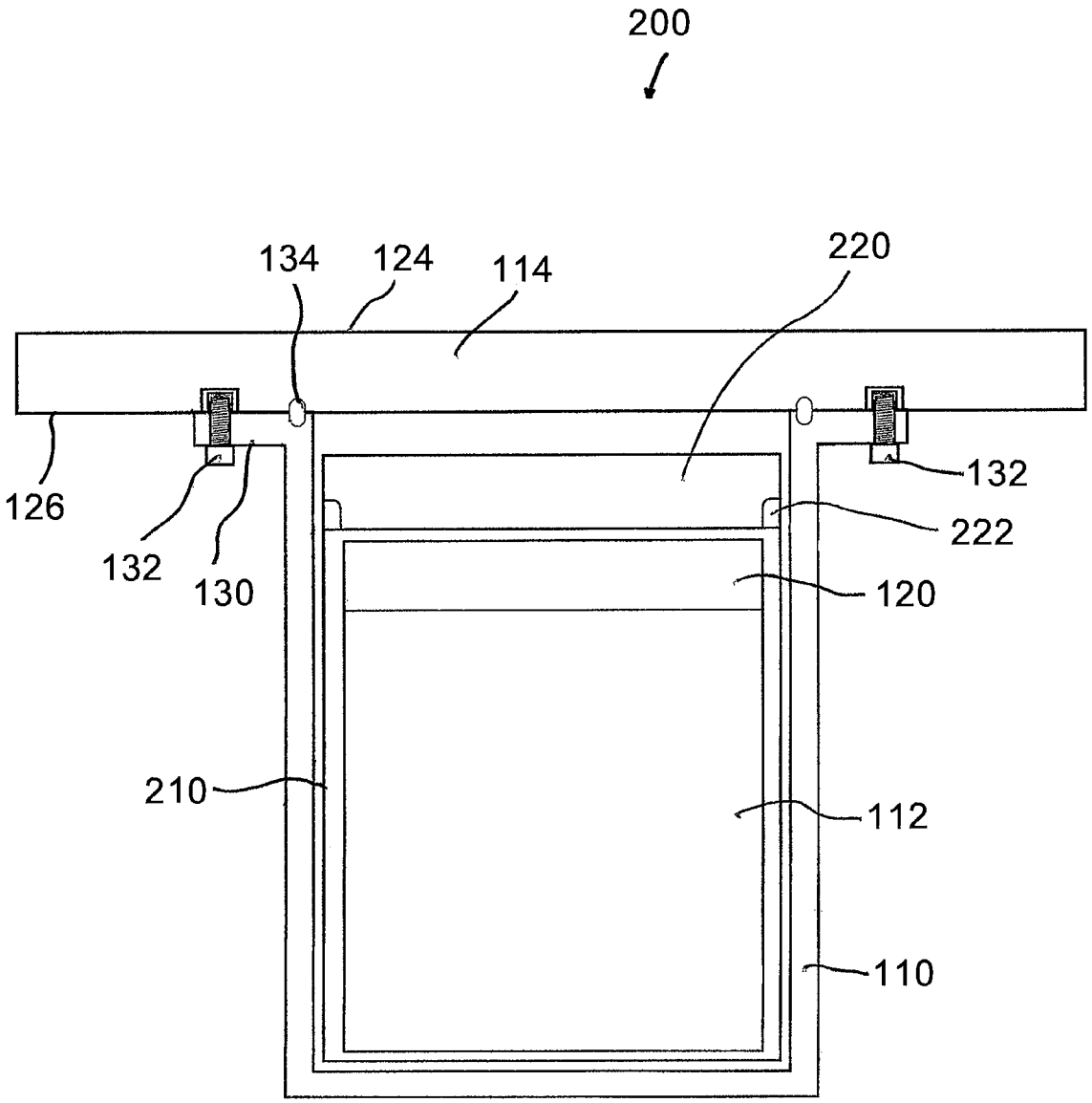
FIG. 3 is a section view of a second embodiment of a portable cremation remains memorial.

Referring now to FIG. 3, a second embodiment of a portable cremation remains memorial is generally identified by the reference numeral 200. As indicated by the use of common reference numerals, the portable cremation remains memorial 200 is similar to the portable cremation remains memorial 100 described hereinabove with the exception that the cremains capsule 112 may be sealed within a second capsule 210 which in turn is housed within the receptacle 110. The open end of the second capsule 210 may be closed by a removable lid 220. A seal or gasket 222 may be secured about the open end of the second capsule 210 which mates with the lid 220 such that a watertight seal may be formed about the open end of the second capsule 210. The triple encapsulation of the decedent's remains in the portable cremation remains memorial 200 may provide redundant sealing means and security, particularly for decedent's remains that may be reinterred multiple times.

Figure 4:
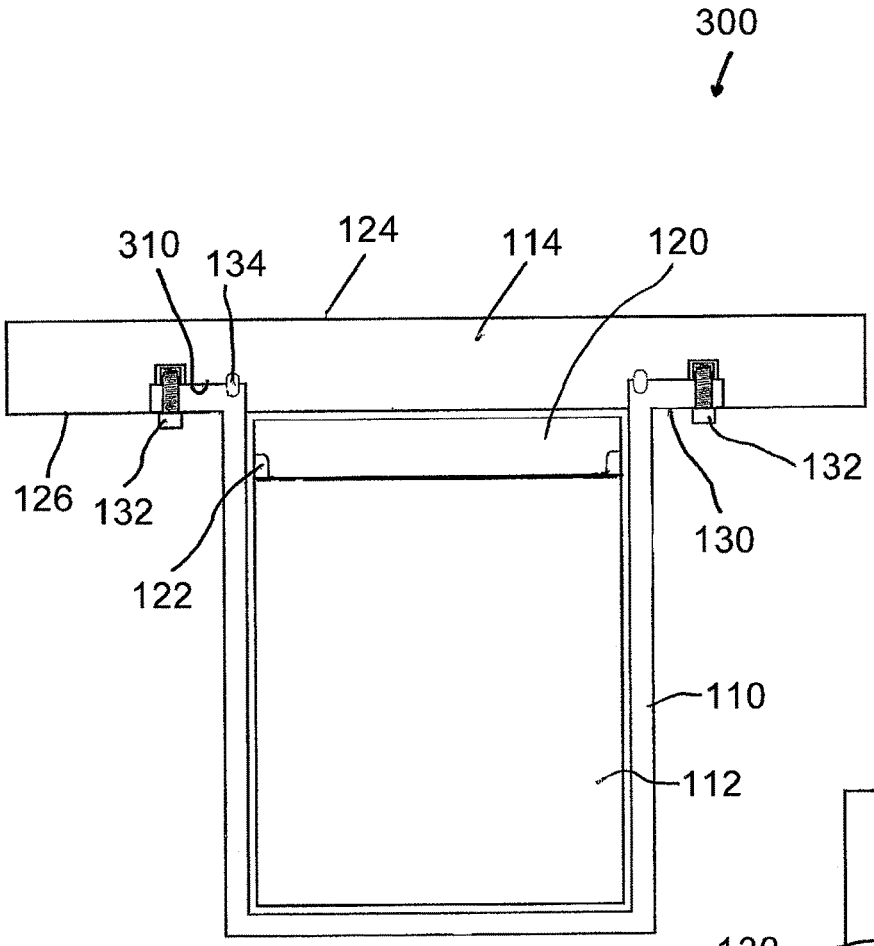
FIG. 4 is a section view of a third embodiment of a portable cremation remains memorial.
Figure 5:
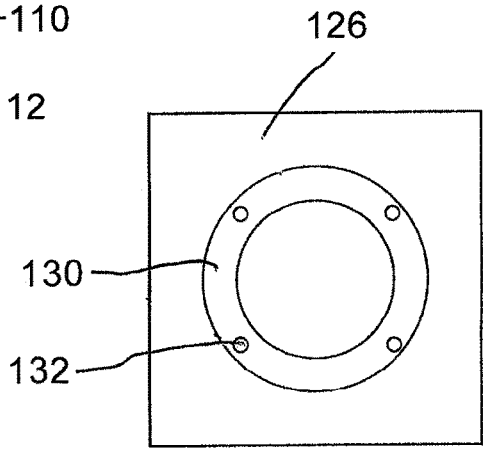
FIG. 5 is bottom plan view of the portable cremation remains memorial shown in FIG. 4.

Referring now to FIG. 4, a third embodiment of a portable cremation remains memorial is generally identified by the reference numeral 300. As indicated by the use of common reference numerals, the portable cremation remains memorial 300 is similar to the portable cremation remains memorial 100 described hereinabove with the exception that a recessed groove 310 may be formed in the bottom surface 126 of the plate 114. The groove 310 may be configured to receive the flange 130 circumscribing the open upper end of the cremation receptacle 110. Mounting bolts 132 received through drilled hole in the flange 130 may secure the cremation receptacle 110 to the plate 114. The seal 134, for example but without limitation, an o-ring or gasket, may be disposed between the bottom surface 126 of the memorial plate 114 and the flange 130 to form a watertight seal about the open upper end of the receptacle 110. The surface contact interface between the flange 130 and the recessed groove 310 provides a circumferential contact sealing area establishing an additional barrier to entry of water or other contaminants into the receptacle 110.

Figure 6:
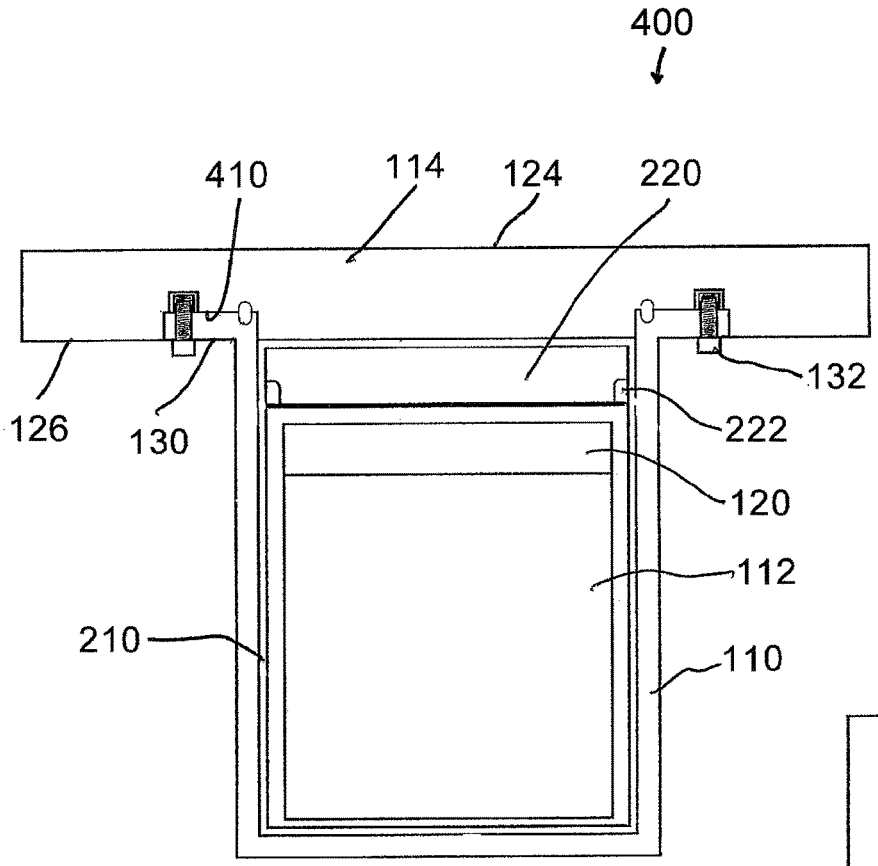
FIG. 6 is a section view of a fourth embodiment of a portable cremation remains memorial.
Figure 7:
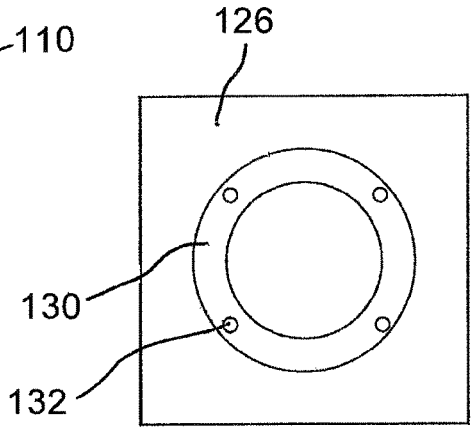
FIG. 7 is bottom plan view of the portable cremation remains memorial shown in FIG. 6.

Referring now to FIG. 6, a fourth embodiment of a portable cremation remains memorial is generally identified by the reference numeral 400. As indicated by the use of common reference numerals, the portable cremation remains memorial 400 is similar to the portable cremation remains memorial 200 described hereinabove with the exception that a recessed groove 410 may be formed in the bottom surface 126 of the plate 114. The groove 410 may be configured to receive the flange 130 circumscribing the open upper end of the cremation receptacle 110. Mounting bolts 132 received through drilled hole in the flange 130 may secure the cremation receptacle 110 to the plate 114.

Figure 8:
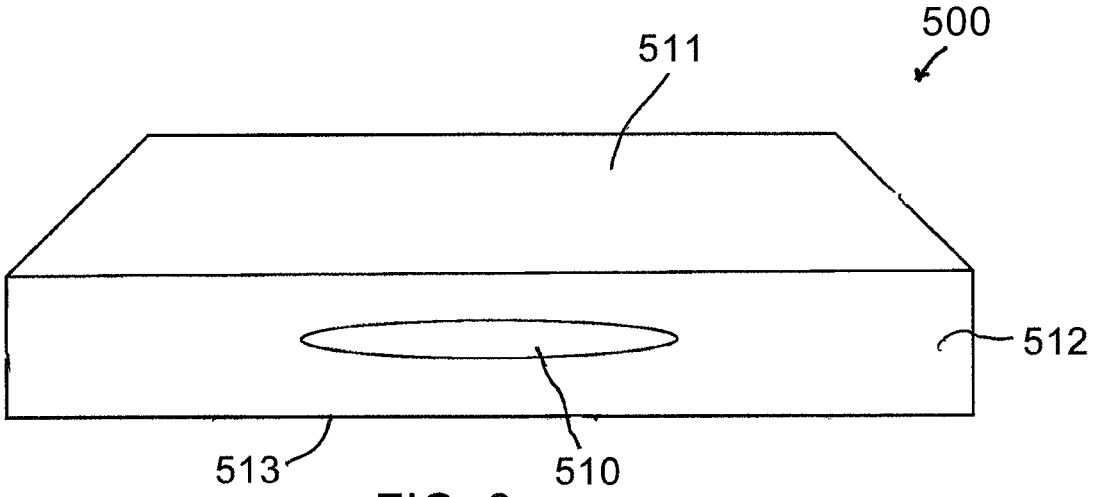
FIG. 8 is a perspective view of an alternate embodiment of a cap plate for a cremation remains memorial.
Figure 9:
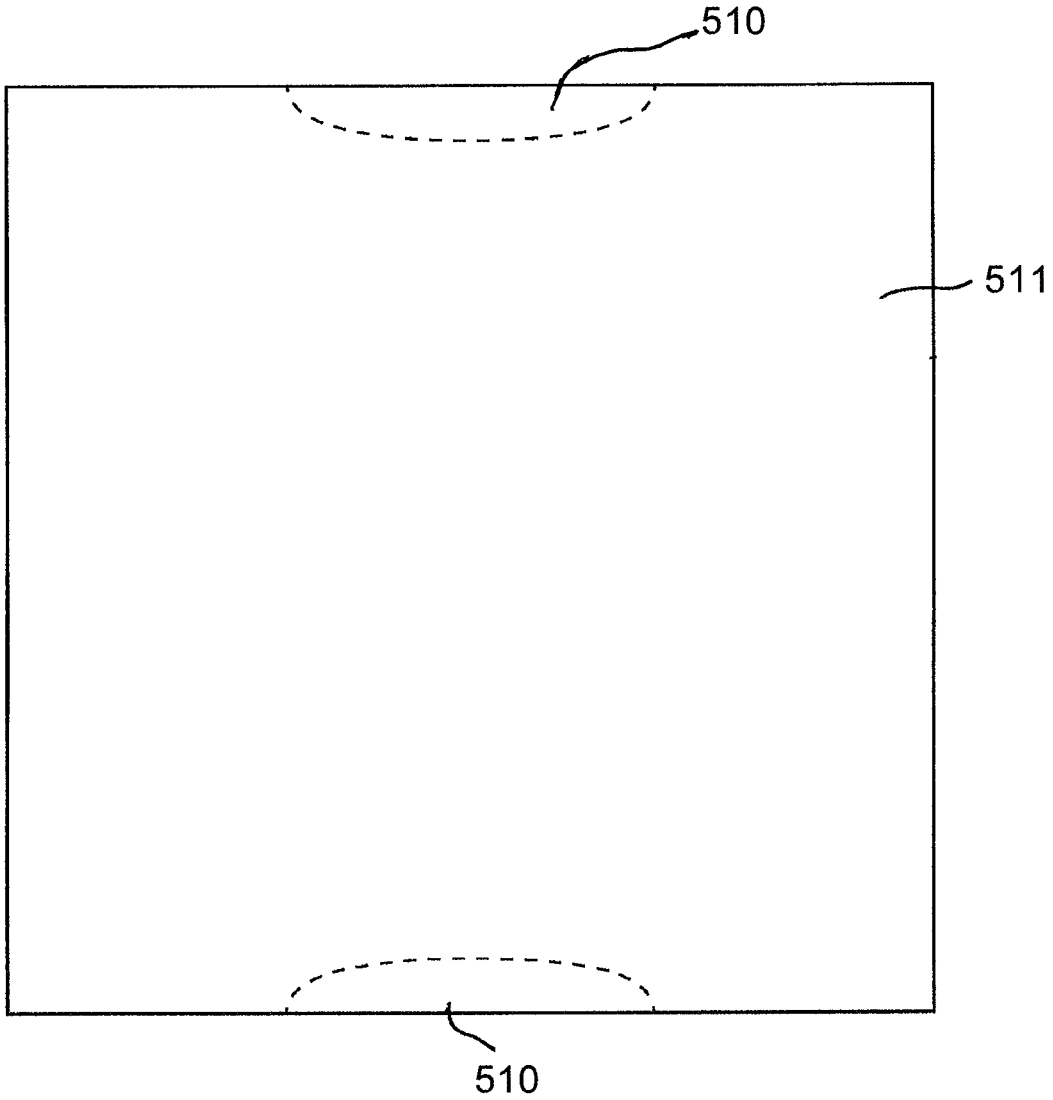
FIG. 9 is a top plan view of the cap plate shown in FIG. 8.

Referring now to FIGS. 8 and 9, an alternate embodiment of a memorial plate for a cremation remains memorial is generally identified by the reference numeral 500, As indicated by the use of common reference numerals, the memorial plate 500 is similar to the memorial plate 114 described above with the exception that the memorial plate 500 may include a top surface 511, sidewalls 512 and a bottom surface 513. Recesses or notches 510 may be formed in one or more of the sidewalls 512 of the memorial plate 500. The notches 510 may provide a convenient handhold for lifting the cremation remains memorial when it is to be interred or reinterred and for portability.

In today's mobile society, individuals and families often move, sometimes far away from where deceased loved ones may be interred. The portable cremation remains memorial described herein may be easily uninterred and transported from one location and reinterred in another location so that family members may have the cremation remains of a decedent interred in a nearby location. The portable cremation remains memorial may be particularly useful for cremation memorialization as it is relatively light and portable. It may be moved from one location to another location with minimal effort.

While preferred embodiments of the invention have been shown and described, other and further embodiments of the invention may be devised without departing from the basic scope thereof, and the scope thereof is determined by the claims which follow.

The invention claimed is:

1. A portable cremation remains memorial, comprising:

a) a receptacle having a closed bottom end and an open upper end, said receptacle including a flange circumscribing said open upper end of said receptacle;

b) a cremains capsule received in said receptacle;

c) a cap plate removably secured over said upper end of said receptacle, said cap plate including a recessed groove configured for receiving said flange of said receptacle; and d) a first seal disposed between an upper edge of said receptacle and said cap plate providing weatherproof storage for cremation remains.

2. The portable cremation remains memorial of claim 1 including mounting bolts removably securing said receptacle to said cap plate.

3. The portable cremation remains memorial of claim 1 including a removable lid secured over an open upper end of said cremains capsule, and a second seal disposed between said lid and said upper end of said cremains capsule.

4. The portable cremation remains memorial of claim 3 wherein said first seal and said second seal include an o-ring or a gasket.

5. The portable cremation remains memorial of claim 1 wherein said cap plate includes a notch in one or more sidewalls of said cap plate providing a handhold for lifting the cremation remains memorial.

6. The portable cremation remains memorial of claim 1 further including a second capsule received in said receptacle, said second capsule configured to receive said cremains capsule providing redundant sealing for cremation remains.

* * * * *